US012484758B2

(12) United States Patent
Kim et al.

(10) Patent No.: US 12,484,758 B2
(45) Date of Patent: Dec. 2, 2025

(54) RACK ASSEMBLY AND DISHWASHER COMPRISING SAME

(71) Applicant: SAMSUNG ELECTRONICS CO., LTD., Suwon-si (KR)

(72) Inventors: Jusik Kim, Suwon-si (KR); Johannes Busing, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 311 days.

(21) Appl. No.: 18/112,540

(22) Filed: Feb. 22, 2023

(65) Prior Publication Data

US 2023/0190072 A1 Jun. 22, 2023

Related U.S. Application Data

(63) Continuation of application No. PCT/KR2021/010100, filed on Aug. 3, 2021.

(30) Foreign Application Priority Data

Aug. 31, 2020 (KR) ..... 10-2020-0110634

(51) Int. Cl.
*A47L 15/50* (2006.01)

(52) U.S. Cl.
CPC ..... *A47L 15/50* (2013.01); *A47L 15/501* (2013.01); *A47L 15/502* (2013.01); *A47L 15/505* (2013.01)

(58) Field of Classification Search
None
See application file for complete search history.

(56) References Cited

U.S. PATENT DOCUMENTS

| | | | |
|---|---|---|---|
| 7,032,604 | B2 | 4/2006 | Welch |
| 7,493,905 | B2 | 2/2009 | Jeong et al. |
| 8,746,467 | B2 | 6/2014 | Jeong |
| 9,119,493 | B2 | 9/2015 | Jeong |
| 2005/0241682 | A1 | 11/2005 | Jeong et al. |
| 2009/0038657 | A1 | 2/2009 | Kang |

(Continued)

FOREIGN PATENT DOCUMENTS

| | | | |
|---|---|---|---|
| CN | 202060740 | U | 12/2011 |
| CN | 205493754 | U | 8/2016 |

(Continued)

OTHER PUBLICATIONS

International Search Report issued in International Application No. PCT/KR2021/010100 dated Nov. 8, 2021.

(Continued)

*Primary Examiner* — Levon J Shahinian
(74) *Attorney, Agent, or Firm* — STAAS & HALSEY LLP

(57) ABSTRACT

A rack assembly comprising a frame; and a fixing rack coupleable to the top of the frame. The fixed rack comprises: a housing forming an outer contour of the fixing rack, the housing including a bottom surface that is at least partially open; a plurality of horizontal ribs, formed on the bottom surface of the housing, and spaced apart from each other; and a plurality of vertical ribs formed on the bottom surface of the housing perpendicular to the plurality of horizontal ribs, and spaced apart from each other, and the fixing rack has a region that is curved along a direction parallel to the plurality of vertical ribs.

16 Claims, 7 Drawing Sheets

(56) References Cited

U.S. PATENT DOCUMENTS

| | | | | |
|---|---|---|---|---|
| 2010/0051069 | A1 | 3/2010 | Schessl et al. | |
| 2012/0181242 | A1* | 7/2012 | Jeong | A47L 15/502 312/228.1 |
| 2014/0239784 | A1 | 8/2014 | Jeong | |

FOREIGN PATENT DOCUMENTS

| | | | |
|---|---|---|---|
| EP | 3 318 170 | A1 | 5/2018 |
| JP | 2001-190481 | A | 7/2001 |
| JP | 2019-030513 | A | 2/2019 |
| KR | 20-1994-0001892 | Y1 | 3/1994 |
| KR | 20-0272336 | Y1 | 4/2002 |
| KR | 10-0879573 | B1 | 1/2009 |
| KR | 10-1069999 | B1 | 10/2011 |
| KR | 10-2012-0084161 | A | 7/2012 |

OTHER PUBLICATIONS

Written Opinion issued in International Application No. PCT/KR2021/010100 dated Nov. 8, 2021.

* cited by examiner

RACK ASSEMBLY AND DISHWASHER COMPRISING SAME

CROSS-REFERENCE TO RELATED APPLICATION(S)

This application is a continuation application, under 35 U.S.C. § 111 (a), of international application No. PCT/KR2021/010100, filed on Aug. 3, 2021, which claims priority of a Korean patent application number 10-2020-0110634, filed on Aug. 31, 2020, in the Korean Intellectual Property Office, the disclosures of which are incorporated by reference herein in their entirety.

BACKGROUND

Technical Field

The disclosure relates to a rack assembly and a dishwasher including same and, more particularly, to a rack assembly including a curved region and a fixing rack for fixing a washing target and a dishwasher including the same.

Description of the Related Art

A dishwasher is a device to wash dishes by spraying high pressure water to dishes.

A general dishwasher includes a machine chamber including a sump and a washing pump; a washing tub; a rack assembly installed inside the washing tub for storing dish; and a spray nozzle spraying water, where the water sprayed from the spray nozzle by the washing pump washes dish.

A washing target of the dishwasher includes cutlery including spoon, fork, knife, in addition to a bowl, a cup, and a pot, and the washing target is placed at an appropriate position in the rack assembly. In addition, the rack assembly has to be fixed so that the washing target may be stably sprayed with water.

A related-art rack assembly has a problem in a situation in which a washing target having a curved shape is placed on the rack assembly that a dish may slide in one direction due to a curved shape of a washing target, and a washing performance falls as the placed target is not fixed.

SUMMARY

A rack assembly according to an embodiment includes a frame and a fixing rack coupleable to a top of the frame, and the fixing rack may include a housing forming an outer contour of the fixing rack, the housing including a bottom surface that is at least partially open; a plurality of horizontal ribs formed on the bottom surface of the housing and spaced apart from each other; and a plurality of vertical ribs, formed on the bottom surface of the housing perpendicular to the plurality of horizontal ribs, and spaced apart from each other, wherein the fixing rack has a region that is curved along a direction parallel to the plurality of vertical ribs.

The region of the fixing rack that is curved includes vertical ribs, and the vertical ribs of the region may be located below adjacent vertical ribs among the plurality of vertical ribs.

The region may include a first curved region and a second curved region, and the first curved region may be formed on one side of the second curved region.

The horizontal ribs disposed on another side of the second curved region, among the plurality of horizontal ribs, may include a plurality of fixing pillars to support a target to be washed.

The first curved region may have a length longer than a length of the second curved region.

The region may include a part descending or rising in an adjacent region by 17 to 18 degrees.

The fixing rack may be coupleable to the frame so that the plurality of horizontal ribs have a preset angle with respect to a bottom surface of the frame.

Each of the plurality of vertical ribs may have a height different from a height of adjacent vertical ribs.

The preset angle may be three degree to four degree.

At least one of the plurality of horizontal ribs may include a bump to prevent the target of holding from sliding downward.

A dishwasher according to a still another embodiment includes a main body; a washing tub to be inside the main body to accommodate a target to be washed; and a rack assembly to allow the target to be washed to be mounted, the rack assembly may include a frame and a fixing rack coupleable to a top of the frame, the fixing rack may include a housing forming an outer contour of the fixing rack, the housing including a bottom surface that is at least partially open; a plurality of horizontal ribs formed on the bottom surface of the housing and spaced apart from each other; and a plurality of vertical ribs, formed on the bottom surface of the housing perpendicular to the horizontal ribs, and spaced apart from each other, and the fixing rack may have a region that is curved along a direction parallel to the plurality of vertical ribs.

The region of the fixing rack that is curved may include vertical ribs, the vertical ribs of the region, may be located below adjacent vertical ribs among the plurality of vertical ribs.

The curved region may include a first curved region and a second curved region, and the first curved region may be formed on one side of the second curved region.

The horizontal ribs disposed on another side of the second curved region, among the plurality of horizontal ribs, may include a plurality of fixing pillars to support the target to be washed.

The first curved region may have a length longer than a length of the second curved region.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
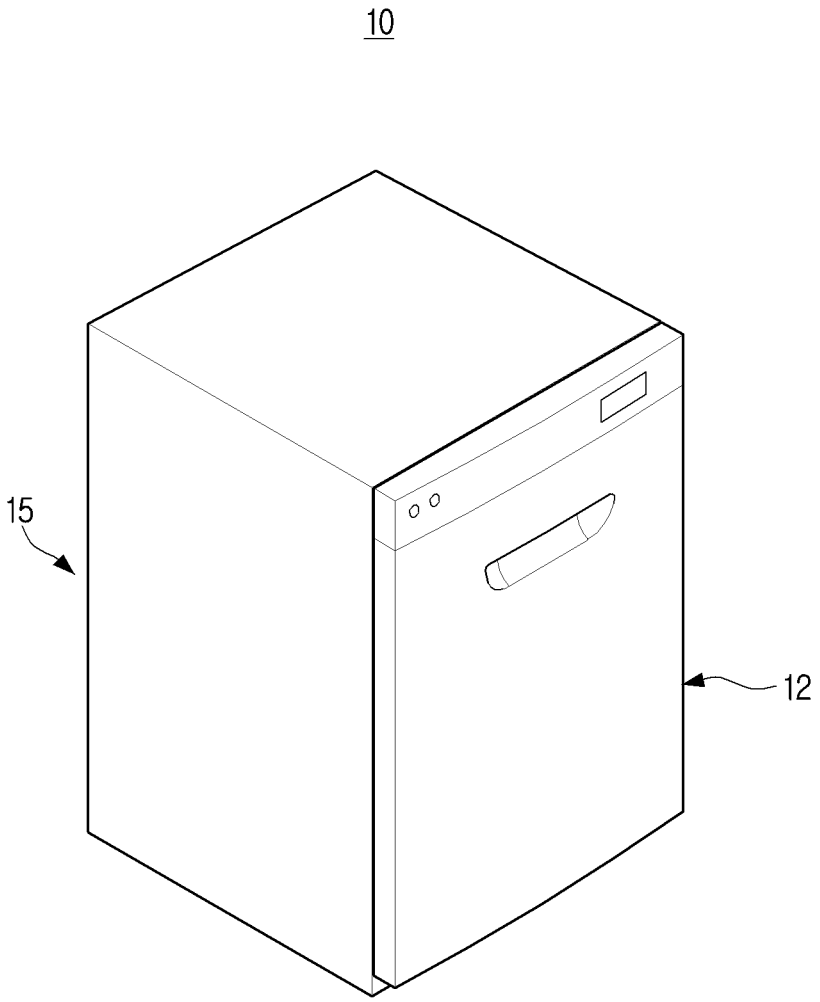
FIG. 1 is a perspective view of a dishwasher according to an embodiment of the disclosure.

Examples described hereinafter are for easy understanding of the disclosure, and it should be understood that various changes may be made to examples described herein and the disclosure may be embodied in different forms. In addition, in the following description, detailed descriptions of well-known functions or configurations will be omitted since they would unnecessarily obscure the subject matters of the disclosure. In addition, it should be noted that the drawings as attached are just for easy understanding of the disclosure, and are not illustrated as really scaled, and dimensions of some elements may be exaggerated.

The terms used in the present specification and the claims are general terms identified in consideration of the functions of the various embodiments of the disclosure. However, these terms may vary depending on intention, legal or technical interpretation, emergence of new technologies, and the like of those skilled in the related art. Also, there may be some terms arbitrarily identified by the applicant. Unless there is a specific definition of a term, the term may be construed based on the overall contents and technological common sense of those skilled in the related art.

In the description of the disclosure, the order of each step should be understood nonrestrictively unless a preceding step must be performed before a subsequent step logically and temporally. That is, except for the exceptional case above, although a process described as a subsequent step is performed before a process described as a preceding step, it does not affect the essence of the disclosure and the scope of the disclosure should be defined regardless of order of steps.

In this specification, expressions "having," "may have," "includes," or "may include," or the like may refer to presence of the corresponding feature (for example: a numerical value, a function, an operation, or a component) and does not exclude the presence of additional features.

Terms such as first and second may be used to describe various components, but the components should not be limited by the terms. The terms may be used only for the purpose of distinguishing one component from another component. For example, without departing from the scope of the disclosure, the first component may be referred to as the second component, and similarly the second component may also be referred to as the first component.

In addition, terms such as "outer circumference", "inner circumference", "upper surface", "lower surface", "side surface", "side", "right side", "top", "bottom", "region" or the like, used in the disclosure are defined based on the drawings, and by each term, the shape and location of each component is not limited.

In the description, the disclosed components of each embodiment are not necessarily limited thereto. Thus, some components may be changed or omitted, and other components may be added. In addition, the components may be distributed in different independent devices.

Further, embodiments of the disclosure are described in detail with reference to the accompanying drawings and the contents described in the accompanying drawings, but the disclosure is not limited or restricted by the embodiments.

One or more embodiments provide a rack assembly including a fixing rack and a dishwasher including the same.

The disclosure will be described in greater detail with reference to FIGS. 1 to 6B.

FIG. 1 is a perspective view of a dishwasher 10 according to an embodiment of the disclosure.

Referring to FIG. 1, the dishwasher 10 may include a main body 15 forming an outer appearance and a door 12 for closing or opening inside of the main body 15.

The dishwasher 10 is a device for spraying water to a washing target such as a dish and washing the same, and may be classified into various types according to the structure and arrangement method of the main body 15. The types of the dishwasher 10 may include a built-in method installed in an empty space provided by separating a part of furniture which is an external support, a free-standing method which may be independently arranged, a counter top method which is arranged in a top counter of the furniture and the like, and an in-sink method which is manufactured by being integrated with the sink.

The dishwasher 10 shown in the drawing is a built-in type dishwasher 10 generally used for home use, but the dishwasher 10 including the rack assembly 100 of the disclosure is not limited thereto, and may also be applied to the rack assembly 100 of another type of dishwasher 10.

The door 12 is rotatably installed on the front surface of the main body 15, and a control device capable of controlling the dishwasher 10 is provided at an upper portion of the door 12, and the user may easily open and close the door 12 and operate the dishwasher 10. A washing tub 20 may be provided inside the door 12.

Figure 2:
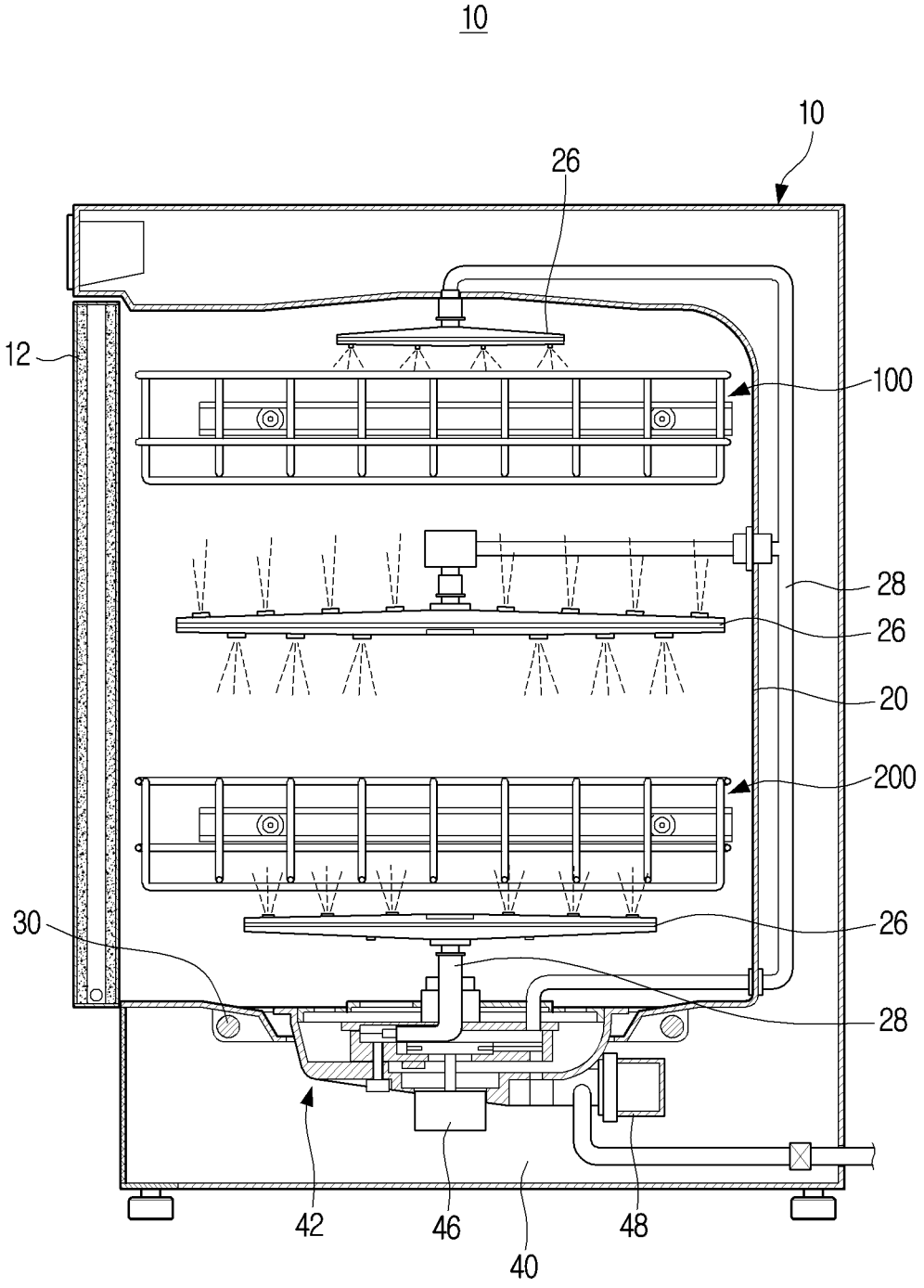
FIG. 2 is a side cross-sectional diagram of a dishwasher according to an embodiment of the disclosure.

FIG. 2 is a side cross-sectional diagram of the dishwasher 10 according to an embodiment of the disclosure.

Referring to FIG. 2, the dishwasher 10 may include the washing tub 20, a mechanic chamber 40, and the rack assembly 100.

The washing tub 20 is a space provided inside the main body 15, and inside the washing tub 20, the rack assembly 100 in which a dish to be washed is placed inside the washing tub 20, a spray nozzle 26 (top) provided on the upper portion of the rack assembly 100 positioned at the uppermost side to spray water, a spray nozzle 26 (middle) disposed between the plurality of rack assemblies 100 to spray water toward each rack assembly 100, and a spray nozzle 26 (lower) provided below the rack assembly 100 positioned on the lower side thereof to spray water.

The spray nozzle 26 is connected to the sump 42 by a supply pipe 28 to receive water. The spray nozzle 26 may evenly spray the water to the washing target accommodated in the plurality of rack assemblies 100 by rotating by the spraying of the water.

A heater 30 for heating water may be provided on the bottom surface of the washing tub 20, and the machine chamber 40 may be provided under the washing tub 20.

The sump 42 for collecting and pumping the water supplied into the washing tub 20 and moving the water to the spray nozzle 26 is provided in the machine chamber 40.

In addition, the sump 42 is provided with various flow paths and a circulation pump 46 for pumping water to the flow path, and a drain pump 48 is provided at one side of the sump 42 to discharge contaminated water to the outside through the drain pipe.

Hereinbelow, an operation process of the dishwasher 10 as described above will be described.

When power is applied while the washing target to be washed is stored in the rack assembly 100 inside the washing tub 20, water required for washing starts to be supplied to the inside of the washing tub 20 through the water supply hole.

The water supplied into the washing tub 20 is collected in the sump 42 provided in the lower part of the washing tub 20, and the water collected by the pumping action of the circulation pump 46 in the sump 42 is supplied to the spray nozzle 26 through the supply pipe 28 to spray the water to the washing target accommodated in the rack assembly 100 at a high pressure, thereby performing a washing process.

When the washing operation is completed, the contaminants on the washing target washed by the water as well as the water are collected in the sump 42, and thus the water containing the contaminants is discharged to the outside through the drain pipe according to the operation of the drain pump 48.

When water containing contaminants is discharged to the outside, clean water is collected in the sump 42 again through a water supply hole, and rinsing is performed by spraying water at high pressure to a washing target through each spray nozzle 26 in the same manner as the washing.

When the rinsing operation is completed, the drying operation is performed, and during the drying operation, the heater 30 is driven to spray high-temperature water to a washing target, and the high-temperature water is vaporized and dried together with the remaining water in a process of vaporizing. Alternatively, high-pressure hot air may be sprayed through a drying process. When the drying is completed, the washing operation is terminated.

The rack assembly 100 may be arranged at the top and the bottom of the washing tub 20, respectively. The rack assembly 100 may be divided into an upper rack assembly 100 and a lower rack assembly 200 according to the arrangement position.

The structure of the fixing rack 110 of the upper rack assembly and the fixing rack 110 of the lower rack assembly may be different, and the top rack assembly will be described for convenience.

Figure 3:
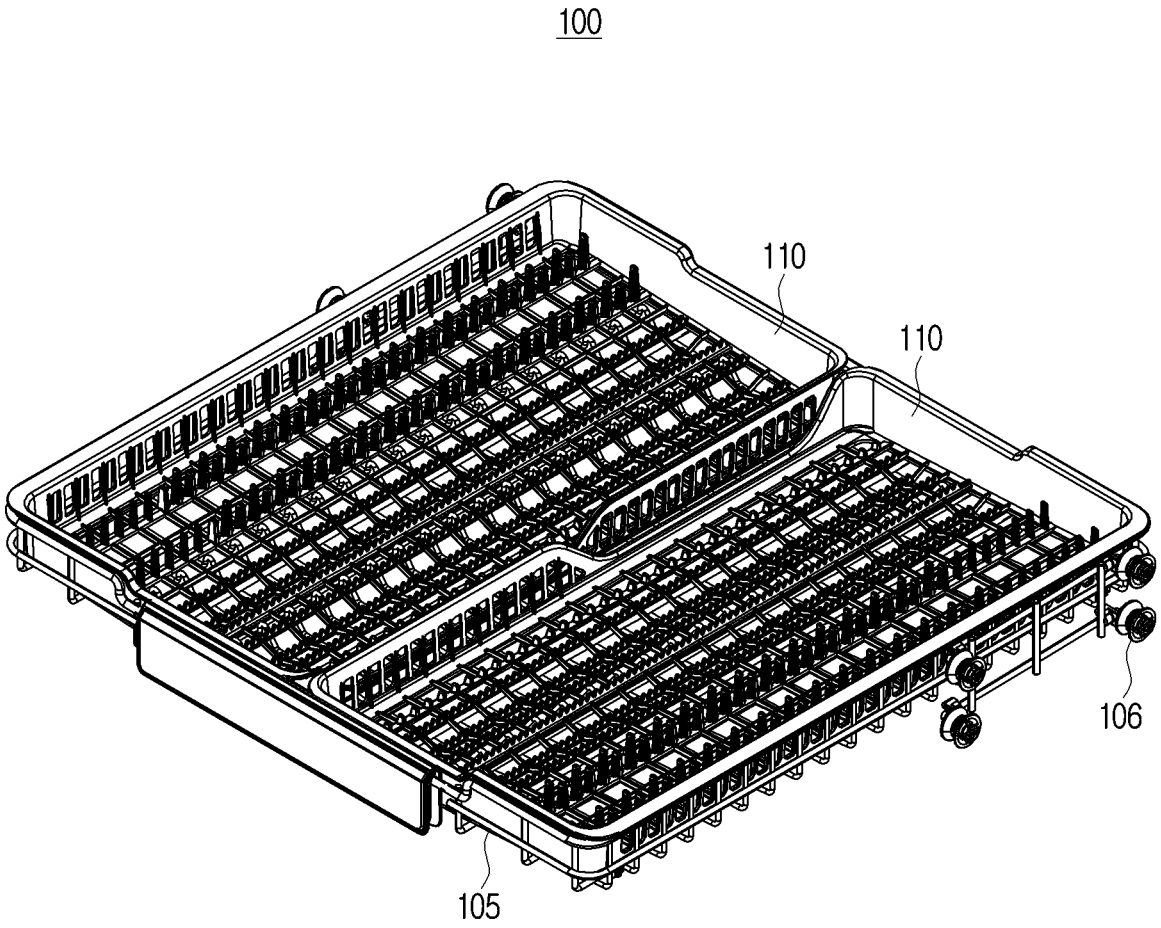
FIG. 3 is a perspective view of a rack assembly according to an embodiment of the disclosure.

FIG. 3 is a perspective view of the rack assembly 100 according to an embodiment of the disclosure.

Referring to FIG. 3, the rack assembly 100 may include a frame 105 and the fixing rack 110.

The frame 105 is a structure for supporting the fixing rack 110, and may have a structure in which a bottom surface is open. The frame 105 may be formed of a metal wire, a handle may be provided on the front surface, and a wheel 106 may be included on the side surface for easy coupling and separation to and from the washing tub 20.

As the bottom surface of the frame 105 is open, the water sprayed from the injection nozzle in the downward direction may be transferred to the dish, and the water may flow in the downward direction.

The frame 105 may include a fixing member to fix the fixing rack 110 coupled to the top, and the fixing member may be inserted into a hole or a side surface of the bottom surface of the fixing rack 110 to fix the fixing rack 110.

The fixing rack 110 is a rack for fixing the dish, and may include a plurality of ribs 120, 130 for supporting the washing target as a structure having an open bottom like the frame 105.

The fixing rack 110 may be made of one body. The housing 115 to be described later, the plurality of ribs may be one body made of the same material by being manufactured through a molding process, or may have a structure in which each of the ribs 120, 130 is coupled to the housing 115.

The rack may include a fixing rack, a lift rack, and the like, one rack may be coupled to the frame 105, or a plurality of racks may be coupled. The rack may be detachable from the frame 105 and replaceable. FIG. 3 is a structure of the rack assembly 100 in which two fixing racks 110 are coupled.

Figure 4:
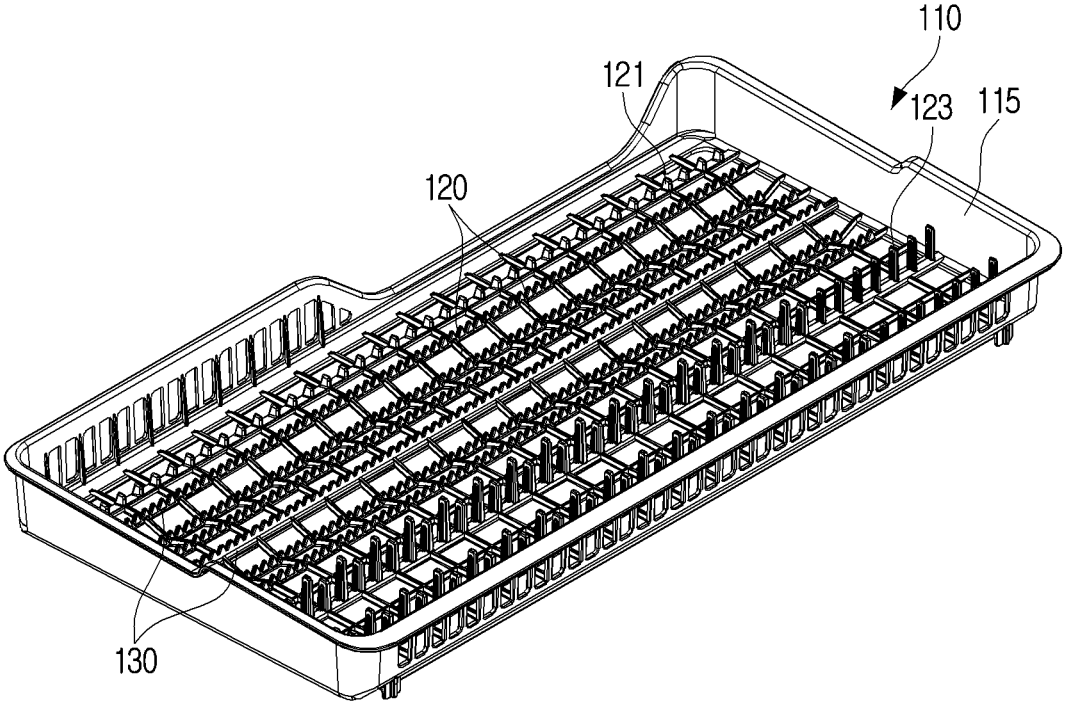
FIG. 4 is a perspective view of a fixing rack according to an embodiment of the disclosure.

FIG. 4 is a perspective view of the fixing rack 110 according to an embodiment of the disclosure.

Referring to FIG. 4, the fixing rack 110 may include a housing 115, a plurality of horizontal ribs 120, and a plurality of vertical ribs 130.

The housing 115 may form an outer contour of the fixing rack 110. The housing 115 may be in the shape of a basket that at least a part of the bottom surface is open. The shape and structure of the housing 115 are not limited, and it seems fine if the washing target may be held and the top surface and the bottom surface are open.

The material of the housing 115 is not restricted, and the material may be a material having a predetermined strength and thermal stability so as not to change the shape and the like even in a high-temperature and high-pressure water.

The plurality of horizontal ribs 120 may be formed on the bottom surface of the housing 115 and spaced apart from each other, and the plurality of vertical ribs 130 may be formed on the bottom surface of the housing 115 and may be spaced apart from each other in a direction perpendicular to the horizontal ribs 120.

The plurality of horizontal ribs 120 and the plurality of vertical ribs 130 form the bottom surface of the housing 115, and as described above, the plurality of horizontal ribs 120 and the plurality of vertical ribs 130 may be made of the same material as the housing 115 or may be made of one body. The plurality of horizontal ribs 120 and the plurality of vertical ribs 130 are formed in a shape of a line extending to one side, but the embodiment is not limited thereto, and may be configured in various forms for forming at least a part of the bottom surface of the housing 115 in an open structure.

At least one of a plurality of vertical ribs 130 may include a plurality of fixing protrusions arranged in one direction. The plurality of fixing protrusions support the washing target, and may fix the washing target not to slide or fall. Accordingly, the washing target may be held in a horizontal direction with the plurality of horizontal ribs 120, and may be supported by the plurality of vertical ribs 130.

The fixing rack 110 may have at least one curved region 125 formed in a direction parallel to a plurality of vertical ribs 130. The curved region 125 may be formed in a shape in which at least a portion of the plurality of horizontal ribs 120 has a curved shape.

Figure 6A:
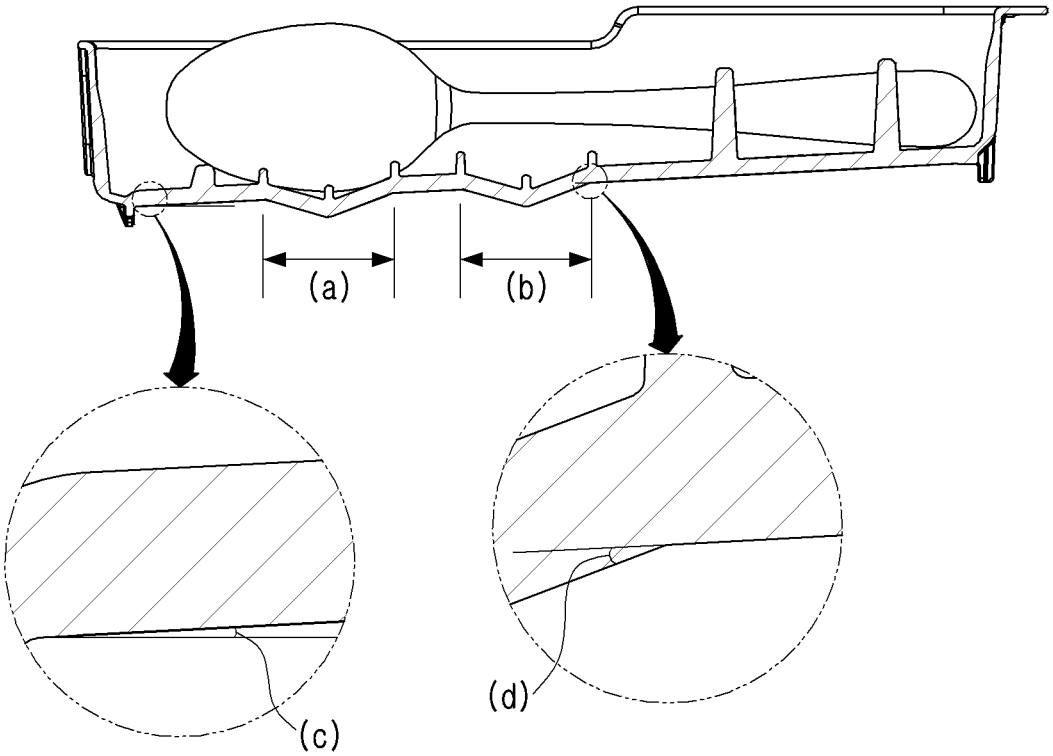
FIGS. 6A and 6B are diagrams illustrating a fixing rack for fixing a washing target according to an embodiment of the disclosure.

The curved region 125 may be formed while a partial region of each of the plurality of horizontal ribs 120 descends and rises again with a predetermined angle (see FIG. 6A). In this case, the preset angle (d) is not restricted, but preferably about 17 to 18 degrees. Alternatively, the curved region 125 may have a curved linear shape or a curved shape such as a hemisphere or a parabola.

A plurality of vertical ribs 130 may be arranged at a height corresponding to a curved region 125. The vertical rib 130 connected to the curved region 125 among the plurality of vertical ribs 130 may be located below an adjacent vertical rib 130.

The fixing rack 110 including the curved region 125 may be effective in holding a curved washing target since the heights of the plurality of vertical ribs 130 are different from each other.

In the case of the fixing rack 110, which does not include the curved region 125, when mounting a washing target in a curved shape, the vertical ribs 130 adjacent to the vertical ribs 130 in contact with a curved region of the washing target are not in contact with the washing target and the corresponding part is not supported appropriately and the washing target may sway.

In contrast, the fixing rack 110 according to an embodiment of the disclosure includes at least one curved region 125, so the vertical ribs 130 connected to the curved region 125 is located below an adjacent vertical rib 130, and even when the curved washing object is mounted, the vertical rib 130 adjacent to the vertical rib 130 of the curved region 125 may also support the washing target, so that the washing target may be more strongly fixed.

As a result, the fixing rack 110 of the disclosure may strongly fix a curved bowl, a cutlery, and the like, so that even when the water is sprayed to the washing target, the fixing rack 110 may not slide or move even when the water is sprayed to the washing target, and the effect of improving washing performance is expected.

Figure 5:
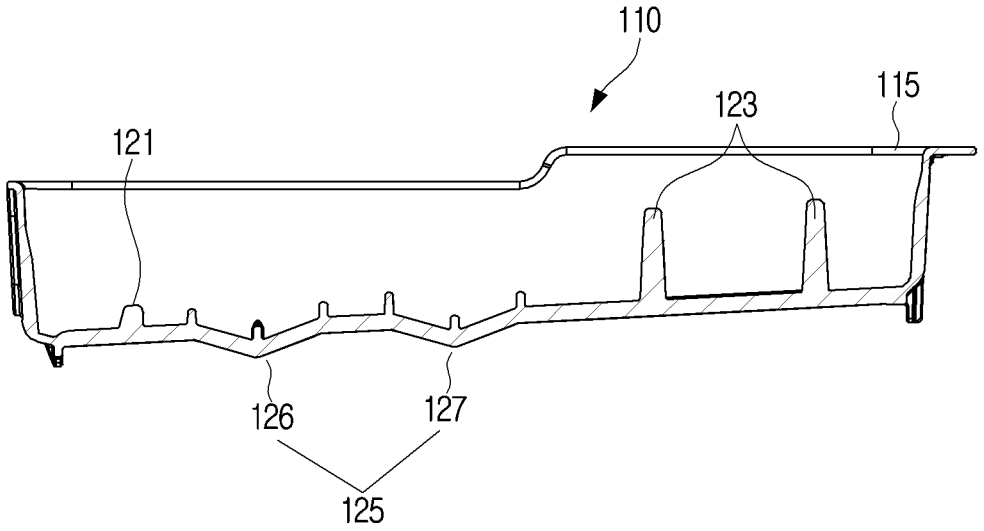
FIG. 5 is a cross-sectional diagram of a fixing rack according to an embodiment of the disclosure.

FIG. 5 is a cross-sectional diagram of the fixing rack 110 according to an embodiment of the disclosure.

Referring to FIG. 5, the fixing rack 110 may be coupled to the frame 105 in an inclined manner, and a plurality of horizontal ribs 120 may include a bump 121, a plurality of fixing pillars 123, a first curved region 126, and a second curved region 127.

The plurality of horizontal ribs 120 of the fixing rack 110 may be coupled to the frame 105 at a predetermined angle with respect to the bottom surface of the frame 105. Each of the vertical ribs 130 may have a different height from an adjacent vertical rib 130. As the height of the plurality of vertical ribs 130 varies, the housing 115 of the fixing rack 110 may flow in the direction of an adjacent low vertical rib 130 without stagnation of water. In order to prevent a washing target from slipping downward, at least one of the plurality of horizontal ribs 120 may include a bump 121.

As an implementation of the inclination angle of the fixing rack 110, the height of the support leg formed on the outer surface of the bottom of the housing 115 of the fixing rack 110 is different, so that the fixing rack 110 may be placed on the frame 105 and the fixing rack 110 may be obliquely coupled to one side. Alternatively, a support member formed on a side surface of the fixing rack 110 has a height gradually increased in one direction, and the fixing rack 110 may be coupled to be inclined in one direction. Alternatively, with respect to the side surface of the housing 115, the plurality of horizontal ribs 120 may rise and extend from one side to the other side so that the horizontal ribs 120 may be coupled to be inclined with different heights with respect to the bottom surface of the frame 105.

As a result, the bottom surface of the housing 115 of the fixing rack 110 may be coupled to the frame 105 to be inclined, thereby allowing the water flow downward without stagnation in the fixing rack 110. In the dishwasher 10, water circulates and wash the dish and the like by the spray pressure of the water, so in the washing step, the water may be continuously circulated without remaining water in the dish and the basket, and a strong washing pressure may be maintained.

The fixing rack 110 of FIG. 5 has a shape in which a plurality of horizontal ribs 120 are arranged from the right side toward the left side and the water may flow to the left.

As the vertical ribs 130 may have an inclined shape, each of the vertical ribs 130 may have a different height with the adjacent vertical ribs 130. Accordingly, the washing target supported by the plurality of vertical ribs 130 may be slid in one direction, but the fixing rack 110 of the disclosure includes the curved region 125 so as to fix the curved dish, the cutlery, and the like in the curved region 125, thereby preventing the washing target from slipping in one inclined direction.

Therefore, the fixing rack 110 of the disclosure may maintain washing pressure by smoothly circulating water, prevent slipping by strongly fixing the washing target, and improve washing performance.

The plurality of horizontal ribs 120 may have a preset angle c (FIG. 6A), that is, 3 to 4 degrees with respect to the bottom surface of the frame 105. The structure for preventing a washing target from slipping due to an inclined angle may be included. As an example, the fixing rack 110 may include the curved region 125 and the bump 121.

The curved region 125 may include a first curved region 126 and a second curved region 127, and the first curved region 126 may be formed on one side of the second curved region 127. In addition, a horizontal rib 120 disposed on a side opposite to one side of a second curved region 127 among the plurality of horizontal ribs 120 may include a plurality of fixing pillars 123 supporting the washing target. The effect of the structure will be described in detail with reference to FIGS. 6A and 6B.

Figure 6B:
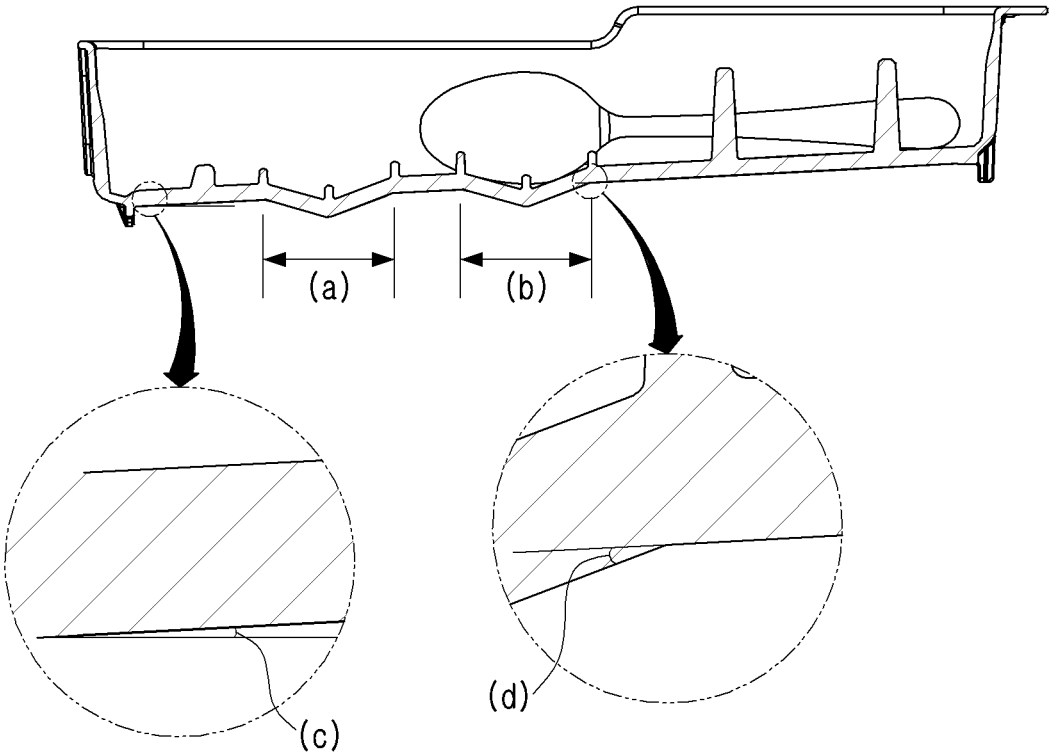

FIGS. 6A and 6B are diagrams illustrating the fixing rack 110 for fixing a washing target according to an embodiment of the disclosure.

Referring to FIGS. 6A and 6B, the fixing rack 110 may stably fix cutlery of various sizes.

The cutlery used in daily life may vary in size, for example, there may be a large spoon and fork used as a cooking tool, and there may be a small spoon, fork used for dessert.

In order to effectively fix the cutlery of various sizes, the horizontal cross-section of the fixing rack 110 of the disclosure may be arranged in the order of the bump 121, the first curved region 126, the second curved region 127, and the fixing pillar 123.

As described above, the fixing rack 110 is inclined at a predetermined angle (c) with respect to the bottom surface of the frame 105, thereby preventing the cutlery from sliding in one direction.

The fixing rack 110 of the disclosure includes the curved region 125 that descends and rises at a predetermined angle (d) in an adjacent region, preferably 17 to 18 degrees, and the length (a) of the first curved region 126 is formed to be longer than the length (b) of the second curved region 127, so that the first curved region 126 may fix a large cutlery having a relatively large size, and the second curved region 127 may fix a relatively small cutlery.

The bump 121 may fix the cutlery fixed to the first curved region 126 not to slide in one direction.

The fixed pillar 123 may support the handle of cutlery fixed to the first curved region 126 and the second curved region 127 and may prevent sliding in a vertical direction.

Therefore, the bottom surface of the fixing rack 110 of the disclosure is inclined to allow the water to smoothly circulate and at the same time, the fixing rack 110 may stably fix the cutlery of various sizes, thereby improving a washing effect.

The various embodiments have been described individually, but it is not necessary that each embodiment is implemented as a sole embodiment, but configurations and operations of each embodiment may be implemented in combination with at least one other embodiment. While preferred embodiments of the disclosure have been shown and described, the disclosure is not limited to the aforementioned specific embodiments, and it is apparent that various modifications may be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. A rack assembly comprising:

a frame; and a fixing rack coupleable to a top of the frame, and including a housing forming an outer contour of the fixing rack, a plurality of horizontal ribs forming a bottom surface of the housing, and each horizontal rib of the plurality of horizontal ribs is spaced apart from another horizontal rib of the plurality of horizontal ribs, and a plurality of vertical ribs forming the bottom surface of the housing perpendicular to the plurality of horizontal ribs, and each vertical rib of the plurality of vertical ribs is spaced apart from another vertical rib of the plurality of vertical ribs, and wherein the plurality of horizontal ribs include:

at least one curved region formed by a descending portion and a rising portion.

2. The rack assembly of claim 1, wherein the at least one curved region includes at least one vertical rib of the plurality of vertical ribs, and the at least one vertical rib of the at least one curved region is located below adjacent vertical ribs of the plurality of vertical ribs.

3. The rack assembly of claim 1, wherein the at least one curved region includes:

a first curved region, a second curved region, and the first curved region is on a side of the second curved region.

4. The rack assembly of claim 3, wherein horizontal ribs of the plurality of horizontal ribs on another side of the second curved region include a plurality of fixing pillars configured to support a target to be washed.

5. The rack assembly of claim 4, wherein a length of the first curved region is longer than a length of the second curved region.

6. The rack assembly of claim 3, wherein the first curved region includes:

a first descending portion that descends at an angle of 17 to 18 degrees relative to a bottom surface of a horizontal rib of the plurality of horizontal ribs, and a first rising portion that rises at an angle of 17 to 18 degrees relative to the bottom surface of the horizontal rib of the plurality of horizontal ribs, and the second curved region includes:

a second descending portion that descends at an angle of 17 to 18 degrees relative to the bottom surface of the horizontal rib of the plurality of horizontal ribs, and a second rising portion that rises at an angle of 17 to 18 degrees relative to the bottom surface of the horizontal rib of the plurality of horizontal ribs.

7. The rack assembly of claim 1, wherein the descending portion descends at an angle of 17 to 18 degrees relative to a bottom surface of a horizontal rib of the plurality of horizontal ribs, and the rising portion is adjacent to the descending portion, and rises at an angle of 17 to 18 degrees relative to the bottom surface of the horizontal rib of the plurality of horizontal ribs.

8. The rack assembly of claim 1, wherein the fixing rack is coupleable to the frame so that, with the fixing rack coupled to the frame, the plurality of horizontal ribs have a preset angle with respect to a bottom surface of the frame.

9. The rack assembly of claim 8, wherein each vertical rib of the plurality of vertical ribs has a height different from a height of an adjacent vertical of the plurality of vertical ribs.

10. The rack assembly of claim 8, wherein the preset angle is three degrees to four degrees.

11. The rack assembly of claim 8, wherein at least one horizontal rib of the plurality of horizontal ribs includes a bump configured to prevent a target to be washed from sliding downward.

12. A dishwasher comprising:

a main body;

a washing tub inside the main body and configured to accommodate a target to be washed; and a rack assembly on which the target to be washed is mountable, and including a frame and a fixing rack coupleable to a top of the frame, wherein the fixing rack includes:

a housing forming an outer contour of the fixing rack, a plurality of horizontal ribs forming a bottom surface of the housing, and each horizontal rib of the plurality of horizontal ribs is spaced apart from another horizontal rib of the plurality of horizontal ribs, and a plurality of vertical ribs forming the bottom surface of the housing perpendicular to the plurality of horizontal ribs, and each vertical rib of the plurality of vertical ribs is spaced apart from another vertical rib of the plurality of vertical ribs, and wherein the plurality of horizontal ribs include:

at least one curved region formed by a descending portion and a rising portion.

13. The dishwasher of claim 12, wherein the at least one curved region includes at least one vertical rib of the plurality of vertical ribs, and the at least one vertical rib of the at least one curved region is located below adjacent vertical ribs of the plurality of vertical ribs.

14. The dishwasher of claim 12, wherein the at least one curved region includes:

a first curved region, a second curved region, and the first curved region is on a side of the second curved region.

15. The dishwasher of claim 14, wherein horizontal ribs of the plurality of horizontal ribs on another side of the second curved region include a plurality of fixing pillars configured to support the target to be washed.

16. The dishwasher of claim 15, wherein a length of the first curved region is longer than a length of the second curved region.

* * * * *